US005260624A

United States Patent [19]

Kim et al.

[11] Patent Number: 5,260,624

[45] Date of Patent: Nov. 9, 1993

[54] PLASMA DISPLAY PANEL

[75] Inventors: Dae-il Kim, Suwon; Yong-ho Gweon, Pusan, both of Rep. of Korea

[73] Assignee: Samsung Electron Devices Co., Ltd., Kyunggi, Rep. of Korea

[21] Appl. No.: 724,591

[22] Filed: Jul. 1, 1991

[30] Foreign Application Priority Data

Jul. 30, 1990 [KR] Rep. of Korea ..... 90-10034

[51] Int. Cl.[5] ..... H01J 1/70; H01J 17/49

[52] U.S. Cl. ..... 313/485; 313/584; 313/585

[58] Field of Search ..... 313/585, 582, 586, 485, 313/584

[56] References Cited

U.S. PATENT DOCUMENTS 4,005,402 1/1977 Amano ..... 313/485 X
4,060,749 11/1977 Shinada et al. ..... 313/585 X
4,423,352 12/1983 Miyazaki et al. ..... 313/584
4,516,053 5/1985 Amano ..... 313/584
4,999,541 3/1991 Kim et al. ..... 313/585 X

FOREIGN PATENT DOCUMENTS 37634 3/1984 Japan ..... 313/586
1-12130 4/1990 Japan ..... 313/582

*Primary Examiner*—Sandra L. O'Shea
*Attorney, Agent, or Firm*—Leydig, Voit & Mayer

[57] ABSTRACT

A PDP that includes a crooked discharge path caused by first and second barriers offset from each other, the ends being in contact with each other. Auxiliary anodes are provided on the end of the first barriers facing a front plate. Auxiliary discharge light produced between the second barriers is intercepted by the first barriers forming the crooked discharge path. The PDP improves contrast of picture and is easy to manufacture.

10 Claims, 1 Drawing Sheet

PLASMA DISPLAY PANEL

BACKGROUND OF THE INVENTION

The present invention relates to a plasma display panel, and more particularly to a direct current-type plasma diplay panel with an auxiliary electrode.

Usually, an auxiliary discharge method is adopted in the DC PDP to acquire a rapid and stable discharge. In the plasma dispaly panel employing the auxiliary discharge method, the auxiliary discharge is to occur before the main discharge so that charged particles formed from the auxiliary discharge facilitate the main discharge.

FIG. 1 illustrates a conventional DC PDP adopting the auxiliary discharge.

Referring to FIG. 1, a plurality of parallel grooves 11 and 21 are formed on the inner surface of front and rear plates 10 and 20 facing each other. Line-shaped main anode 12 is inserted into the grooves 11 on the front plate 10, and auxiliary anode 22 is inserted into the grooves 21 on the rear plate 20. A plurality of striped cathodes 24 are arranged in the orthogonal direction of the grooves 21 on the inner surface of the rear plate 20. A plurality of through holes 25 facing the grooves 21 are formed at proper intervals. In the conventional PDP, auxiliary discharge occurs between cathodes 24 and auxiliary anodes 22 arranged in X-Y matrix on the rear plate 20 and the charged particles produced from the auxiliary discharge are supplied to the main discharge region between the cathodes 24 and main anodes 12 via the through holes 25. The charged particles supplied to the main discharge region facilitate the occurrence of the main discharge between anodes 12 and cathodes 24 since the particles are being supplied between the anodes 12 and cathodes 24.

The above conventional PDP is characterized by a high contrast ratio since the PDP has a structure such that the auxiliary discharge cannot pass through the front plate which is different from the PDPs employing other auxiliary discharge methods. However, the aformentioned PDP is disadvantageous in that the charged particles are not sufficiently supplied because the charged particles produced from the auxiliary discharge are supplied to the main discharge region via the front plate and through holes. In addition, Grooves of a certain depth in which anodes and auxiliary anodes are inserted should be formed on the front and rear plates. Such structural complexity results in low productivity and obstructing mass production.

SUMMARY OF THE INVENTION

Therefore, it is an object of the present invention to provide a PDP which effectively utilizes charged particles by an auxiliary discharge and has an improved contrast ratio by effectively intercepting auxiliary discharged light that is irrelevant to the image display.

To achieve the objects, the PDP of the present invention comprises front and rear plates set a certain distance apart; a plurality of striped anodes and cathodes arranged in an X-Y matrix on the inner surfaces of the front and rear plates; first barriers formed between the anodes in parallel therewith at a predetermined height; second barriers offset from the first barriers, the upper end being in contact with that of the first barriers; auxiliary anodes provided on the upper end of the first barrier, and being orthogonal with the cathodes of the rear plate and facing the cathodes.

BRIEF DESCRIPTION OF THE DRAWINGS

The above object and other advantages of the present invention will become more apprarent by describing in detail a preferred embodiment of the present invention with reference to the attached drawings in which.

DETAILED DESCRIPTION OF THE INVENTION

Figure 1:
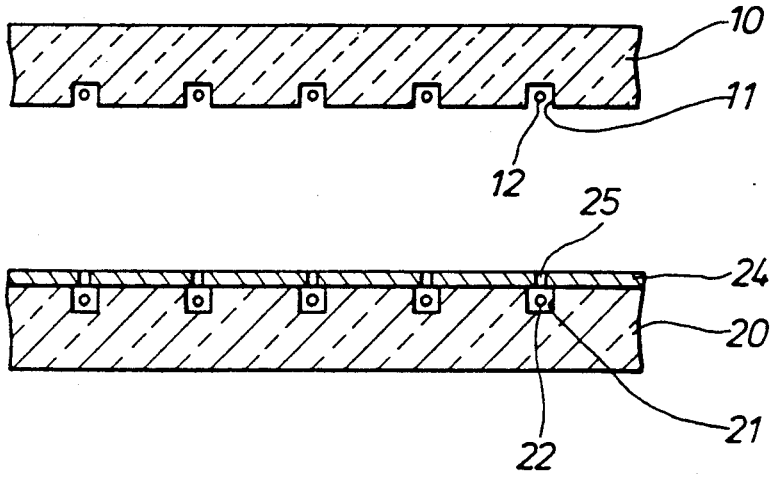
FIG.1(PRIOR ART)
FIG. 1 is a schematic cross sectional view of the conventional PDP.
Figure 2:
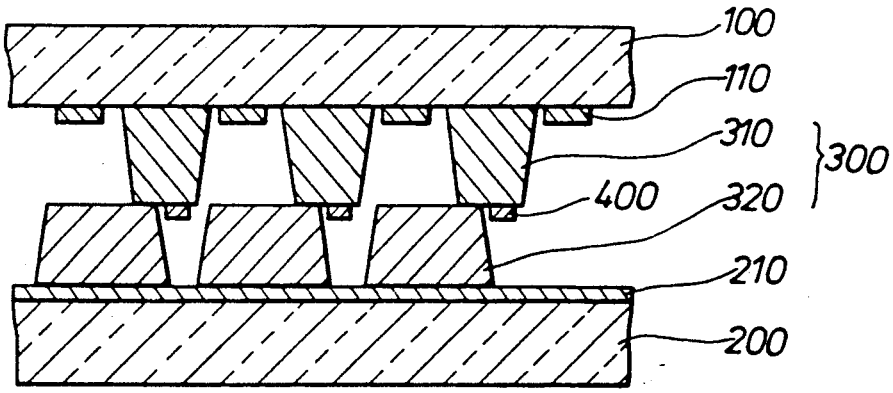
FIG. 2 is a schematic cross sectional view of a PDP according to the present invention.

FIG. 2 illustrates a DC PDP of the present invention. The PDP of the present invention is constructed such that main anodes 110 and auxiliary anodes 400 in the X-Y matrix are provided on the inner surface of front and rear plates 100 and 200, and a means 300 for preventing cross talk is provided between the main and auxiliary anodes 110 and 400. The means for preventing cross talk 300 includes first barriers 310 formed on the front plate 100 and second barriers 320 offset from the first barriers 310 and being in contact therewith. The first barriers 310 are formed on the front plate 100, orthogonal with the cathodes 210, and striped auxiliary anodes 400 facing the cathodes 210 are formed on the end. The auxiliary anodes 400 are formed on the remaing region where the end of the second barriers 320 are not in contact.

The striped main anodes 110 provided on the inner surface of the front plate 100 are made of transparent ITO (Indium Tin Oxide) and are formed by a photolithography method. The striped cathodes 210 provided on the inner surface of the rear plate 200 are made of material having a great endurance of ion bambardment such as nickel paste. The cathodes 200 are formed by a conventional screen print method. Then, the first and second barriers 310 and 320 of the means for preventing cross talk 300 are formed using a screen print method with frit glass several times. The first barriers 310 are formed after the main anodes 110 are formed on the front plate 100 and the second barriers 320 are formed by a different process from the first barriers 310 on the rear plate 200 in which the cathodes 210 are formed. In manufacturing the auxiliary anodes 400 of the first barriers 310, screen printing is employed. It is desirable that the ends of the first barriers 310 are abraded to make them smoother in order to obtain better auxiliary anodes 400. Further, the ends of the second barriers which are in contact with the first barriers are abraded to adhere closely to the first barriers. Thus, cross talk can be more effectively prevented.

In the same way as the conventional auxiliary discharge-type PDP, the PDP of the present invention described above makes an auxiliary discharge occur between the auxiliary anodes and cathodes before the main discharge occurs between the main anodes and cathodes, then utilizes the charged particles produced from the auxiliary discharge. As the main discharge path of the present invention becomes crank shaped or Z shaped by the first and second barriers offset from each other, the main discharge occurs through the crooked path and the auxiliary discharge before the main discharge occurs between the cathodes and auxiliary anodes, that is, through a narrow space located between the second barriers and partly veiled by the first barrier. Accordingly, a great amount of the discharge light produced from the auxiliary discharge is intercepted by the first barriers, which minimizes the amount of the auxiliary discharge light passing through the front plate. The interception of the auxiliary discharge light irrelevant to image display from the front plate results in the improvement of picture contrast. In addition, since the auxiliary discharge occurs within the main discharge region, the whole quantity of charged particles produced from the auxiliary discharge facilitates the main discharge, which allows the main discharge to occur more easily even though the intensity of auxiliary discharge is lower than the prior art.

As described above, the PDP of the present invention effectively intercepts the auxiliary discharge light irrelevant to image display, thereby realizing a better image. Further, the structure to intercept the auxiliary discharge light is simpler to manufacture than in the prior art.

Meanwhile, since the discharge path of the present invention is crooked, the PDP of the present invention has a longer discharge path than the straight discharge path of the prior art. That means that the PDP of the present invention is more adapted for a color-mode PDP. That is, the PDP of the present invention has a longer anode-sided positive column during discharge, which produces a great amount of ultraviolet rays to be required in the color-mode PDP. It is desirable to agglutinate colored phosphor on the side of the first barriers adjacent to the anodes in the color-mode PDP.

The PDP of the present invention as described above is adaptable for both monochrome and color modes and provides an extensive improvement.

Any PDP will be within the scope of the present invention, which is constructed such that a discharge path, that is the feature of the present invention, is formed by two barriers offset from each other, and the auxiliary anodes, facing the cathodes on the rear plate, are installed on either of the two barriers so that light discharged by the auxiliary discharge is intercepted by the barriers.

What is claimed is:

1. A display assembly for use in a plasma display panel comprising:

front and rear plates spaced apart wherein at least one of the front and rear plates is transparent;

a gas disposed between the front and rear plates;

a plurality of striped anodes and cathodes in a X-Y matrix respectively arranged on inner surfaces of said front and rear plates;

first barriers alternately disposed between said striped anodes and in parallel therewith at a predetermined height and having respective first upper ends;

second barriers having second upper ends respectively being in contact with and offset from the first upper ends thereby defining a first region of the first upper end which is not in contact with the second upper end, the first barriers and the second barriers being disposed between the front and rear plates; and auxiliary anodes respectively provided on first regions of the first upper ends of said first barriers, said auxiliary anodes being orthogonal with the cathodes of said rear plate and facing the cathodes.

2. A display assembly as caimed in claim 1, wherein the ends of said first barriers are abraded to be smooth.

3. A display assembly as caimed in claim 1, wherein colored phosphor is agglutinated on the side of said first barriers.

4. A display assembly as claimed in claim 2, wherein colored phosphor is agglutinated on the side of said first barriers.

5. A display assembly as claimed in claim 1, wherein the ends of said second barriers are abraded to be smooth.

6. A display assembly for use in a plasma display panel comprising:

a transparent front plate;

a back plate disposed substantially parallel to and spaced apart from the transparent front plate;

a gas disposed between the transparent front plate and the back plate;

a plurality of striped first electrodes disposed substantially in parallel on an inner surface of the rear plate;

a plurality of striped second electrodes spaced apart and disposed on an inner surface of the front plate substantially orthogonally to the plurality of striped first electrodes, for generating a main discharge in a main discharge region;

a plurality of auxiliary electrodes, each auxiliary electrode of the plurality of auxiliary electrodes opposing at least one of the plurality of striped first electrodes, for generating an auxiliary discharge in a auxiliary discharge region; and a plurality of barriers disposed between the transparent front plate and the back plate for preventing cross-talk wherein respective barries include an overhanging region spaced from the transparent front plate and the back plate and opposing at least one of the plurality of striped first electrodes, wherein the plurality of auxiliary electrodes are respectively disposed on the overhanging regions, the overhanging regions at least partly veiling light produced by the auxiliary discharge, preventing the veiled light from reaching the transparent front plate, and wherein the main discharge region includes the auxiliary discharge region and each of the auxiliary discharge regions is respectively disposed below each of the overhanging regions.

7. A display assembly as claimed in claim 6 wherein the main discharge region defines a crooked discharge path.

8. A display assembly as claimed in claim 6 wherein the crooked discharge path is crank shaped.

9. A display assembly as claimed in claim 6 wherein the crooked discharge path is "Z" shaped.

10. A display assembly as claimed in claim 6 wherein each of the respective barriers include:

first barriers alternately disposed between said plurality of striped second electrodes and having respective first upper ends; and second barriers having second upper ends respectively being in contact with and offset from the first upper ends thereby defining the overhanging region on the first upper end which is not in contact with the second upper end.

* * * * *

UNITED STATES PATENT AND TRADEMARK OFFICE

CERTIFICATE OF CORRECTION

PATENT NO. : 5,260,624

DATED : November 9, 1993

INVENTOR(S) : Kim et al.

It is certified that error appears in the above-indentified patent and that said Letters Patent is hereby corrected as shown below:

Claim 6, column 4, line 34, change "barries" to --barriers--.

Signed and Sealed this

Tenth Day of May, 1994

Bruce Lehman

*Attest:*

BRUCE LEHMAN

*Attesting Officer*

*Commissioner of Patents and Trademarks*